US007036488B2

(12) United States Patent
Nather et al.

(10) Patent No.: US 7,036,488 B2
(45) Date of Patent: May 2, 2006

(54) FUEL DELIVERY UNIT

(75) Inventors: Helmut Nather, Bad Camberg (DE); Wolfgang Sinz, Sulzbach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/506,307

(22) PCT Filed: Feb. 18, 2003

(86) PCT No.: PCT/DE03/00509

§ 371 (c)(1),
(2), (4) Date: Sep. 1, 2004

(87) PCT Pub. No.: WO03/074863

PCT Pub. Date: Sep. 12, 2003

(65) Prior Publication Data

US 2005/0103314 A1 May 19, 2005

(30) Foreign Application Priority Data

Mar. 1, 2002 (DE) ..... 102 08 824

(51) Int. Cl.
*F02M 37/04* (2006.01)

(52) U.S. Cl. ..... 123/509; 123/497

(58) Field of Classification Search ..... 123/516, 123/509, 514, 497, 198 DB; 73/305, 319, 73/322.5; 137/565.16, 393, 398, 574; 417/36, 417/40, 423.3, 211.5
See application file for complete search history.

(56) References Cited

U.S. PATENT DOCUMENTS

| | | | | |
|---|---|---|---|---|
| 4,253,332 | A * | 3/1981 | Sabatino et al. | 73/224 |
| 4,441,860 | A * | 4/1984 | Tsujimoto | 471/40 |
| 4,974,570 | A | 12/1990 | Szwargulski et al. | |
| 5,080,077 | A * | 1/1992 | Sawert et al. | 123/514 |
| 5,887,617 | A | 3/1999 | Frank | |
| 5,979,485 | A | 11/1999 | Tuckey et al. | |

FOREIGN PATENT DOCUMENTS

| | | |
|---|---|---|
| DE | 44 35 508 A1 | 4/1996 |
| DE | 195 47 097 A1 | 6/1997 |
| JP | 02157468 A | 6/1990 |

* cited by examiner

*Primary Examiner*—Thomas Moulis
(74) *Attorney, Agent, or Firm*—Richard A. Speer; Mayer, Brown, Rowe & Maw LLP

(57) ABSTRACT

The invention relates to a fuel delivery unit (2) that is disposed in the fuel tank (1) of a motor vehicle, the delivery unit comprising a level sensor (13) that detects when the amount of fuel in a surge chamber (3) falls below a minimum amount. When the fuel in the surge chamber (3) falls below a defined minimum, the supply of power to a delivery pump (4) that is driven by an electromotor is interrupted, thereby preventing the delivery pump (4) from delivering air when the surge chamber (3) is empty.

7 Claims, 1 Drawing Sheet

FUEL DELIVERY UNIT

BACKGROUND OF THE INVENTION

The invention relates to a fuel delivery unit which is provided for arrangement in a fuel tank of a motor vehicle, having a surge chamber for collecting fuel and having a delivery pump for delivering fuel from the surge chamber to an internal combustion engine of the motor vehicle.

Fuel delivery systems of this type are frequently used in modern motor vehicles and are known from practice. The surge chamber is generally arranged at a location in the fuel tank in which it is preferably filled during a first filling of the tank. The surge chamber is therefore also filled.

A disadvantage of the known fuel delivery units is, however, that, when the surge chamber is virtually empty, air can be sucked in by the delivery pump and can accumulate in the lines leading to the internal combustion engine. When reserve fuel is fed in thereafter, the air situated in the lines prevents fuel from being able to be delivered to the internal combustion engine. Furthermore, the delivery pump may be damaged if it runs dry.

The invention is based on the object of designing a fuel delivery unit of the type mentioned at the beginning in such a manner that it reliably prevents air from passing into the lines leading to the internal combustion engine.

BRIEF DESCRIPTION OF THE INVENTION

This problem is solved according to the invention by including in the surge chamber a level sensor for detecting the level of fuel contained in the chamber and controlling operation of the delivery pump, depending upon the fuel level sensed.

This design enables the delivery pump to be activated as a function of the filling of the surge chamber. This makes it possible to switch off the delivery pump if the fuel level in the surge chamber drops below a designated limit. It can therefore be ensured that the suction region of the delivery pump is situated at all times below the fuel level. Therefore, even if the surge chamber is virtually empty, air is reliably prevented from being sucked up by the delivery pump and blocking the lines leading to the internal combustion engine. In addition, damage to the delivery pump by it running dry is reliably prevented.

According to an advantageous development of the invention, the level sensor can be manufactured particularly cost-effectively if it has a reed switch. Furthermore, a reed switch of this type delivers an unambiguous switching signal which can be reliably assigned to a certain filling level of fuel.

According to another advantageous development of the invention, the level sensor is particularly stable if it includes a cylindrical member, such as a pipe which extends over a subregion of the height of the surge chamber.

The fuel delivery unit according to the invention can be fitted in a particularly simple manner if the pipe of the level sensor is fastened to a cover of the surge chamber and projects downwardly into the surge chamber.

During vertical excursions of the level sensor, jamming can be reliably prevented, according to another advantageous development of the invention, if a float comprising one part of the level sensor is guided on the pipe. This also ensures that, after the delivery pump has been switched off, a feeding-in of reserve fuel can be detected and the delivery pump can be restarted.

According to another advantageous development of the invention, the level sensor turns out to be particularly compact and is of particularly simple construction if a magnetic switch of the level sensor and the float are arranged in the pipe.

Sloshing movements of the fuel may exert short-term effects on the level sensor, thereby creating an erroneous signal that the fuel in the surge chamber has dropped below a minimum amount. According to another advantageous development of the invention, the influence of sloshing movements of the fuel can be kept particularly small if the pipe of the level sensor includes an opening that constricts the flow of air or fuel and therefore damps the movements of the fuel in the pipe.

Magnetic fields of an electric motor driving the delivery pump may result in faulty signals of the level sensor. However, according to another advantageous development of the invention, the influence of the magnetic fields of the electric motor on the level sensor can be kept particularly small if the level sensor is spaced apart from the delivery pump. The pipe is preferably arranged spatially separated from the delivery pump.

The activation of the delivery pump driven by the electric motor does not require any additional components, apart from the level sensor, if the level sensor has a switch and is connected directly to the delivery pump.

If the level sensor should fail, the fuel delivery unit according to the invention can be operated at least with an emergency program by means of an electronic control system for detecting signals of the level sensor and for activating the delivery pump. An electronic control system of this type can be used, in addition, to detect fluctuations of the fuel level in the surge chamber. The level sensor does not therefore require any mechanical damping elements or constricting openings.

BRIEF DESCRIPTION OF THE DRAWINGS

The invention permits numerous embodiments. To further clarify its basic principle, one of these is illustrated in the drawing and is described below. In the drawing

DETAILED DESCRIPTION OF THE INVENTION

Figure 1:
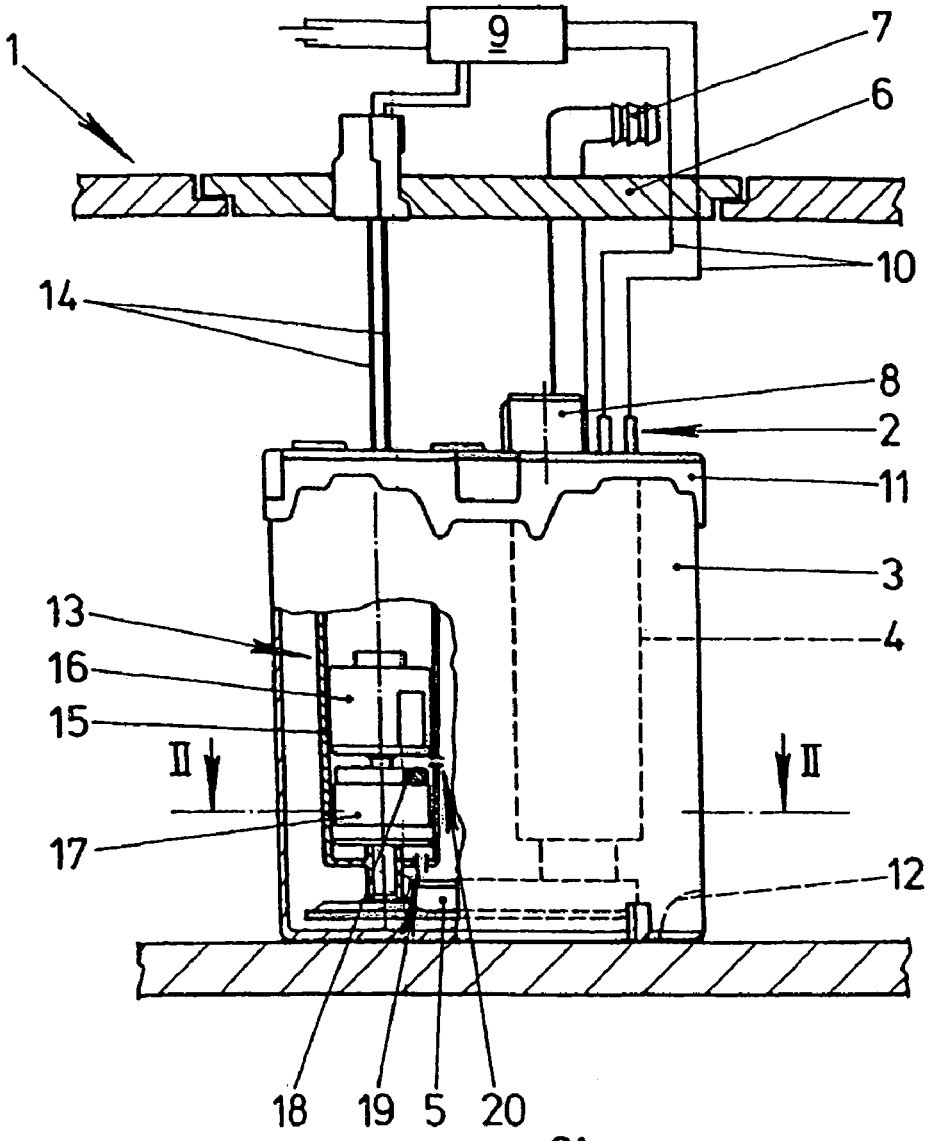
FIG. 1 shows a partial section through a fuel delivery unit according to the invention fitted in a fuel tank.

FIG. 1 shows a fuel tank 1 of a motor vehicle having a fuel delivery unit 2 which is arranged in it and is intended for delivering fuel. The fuel delivery unit 2 has a delivery pump 4 which is arranged in a surge chamber 3 and is driven by an electric motor. The delivery pump 4 delivers fuel via a filter 5, which is arranged in the surge chamber 3, to a connecting branch 7 arranged on an installation closure 6 which seals an access opening into fuel tank 1. A forward flow line (not illustrated) leading to an internal combustion engine of the motor vehicle can be connected to the connecting branch 7. The pressure delivered by the delivery pump 4 is limited by a pressure regulator 8. The delivery pump 4 is supplied with electric current by an electronic control system 9 via electric lines 10. The surge chamber 3 is latched to surge chamber 11. The cover 11 enables the surge chamber 3 to exchange air with the remaining regions of the fuel tank 1 and enables fuel to pass in from above into the surge chamber 3. The surge chamber 3 also has a bottom valve 12 via which fuel can pass into the surge chamber 3, but cannot escape. The surge chamber 3 can, of course, additionally be filled with fuel via a suction jet pump (not illustrated).

A level sensor 13 is arranged in the surge chamber 3 at a pre-selected distance from the delivery pump 4. The level sensor 13 is likewise connected via electric lines 14 to the electronic control system 9 and in a preferred construction includes a pipe 15 which is fastened to the cover 11 of the surge chamber 3. A reed switch 16 is arranged within the pipe 15 and is positioned opposite a float 17. The float 17 bears a magnet 18 and moves up and down with changes in the fuel level in surge chamber 3. In order to ensure that the pipe 15 exchanges flow with the surge chamber 3, the pipe 15 has openings 19, 20, which are designed as constricting openings in order to damp sloshing movements of the fuel against the float 17. When there is a sufficient fuel level in the surge chamber 3, the float 17 is pressed upward against the reed switch 16 by means of the magnet 18. The level sensor 13 then supplies a fuel level response signal to the electronic control system 9 which enables the delivery pump 4 to be supplied with power. If the fuel level in the surge chamber 3 drops below the minimum value, the magnet 18 moves away from the reed switch 16, whereupon the latter supplies a signal to the electronic control system 9. The electronic control system 9 then suppresses the supply of power to the delivery pump 4.

Figure 2:
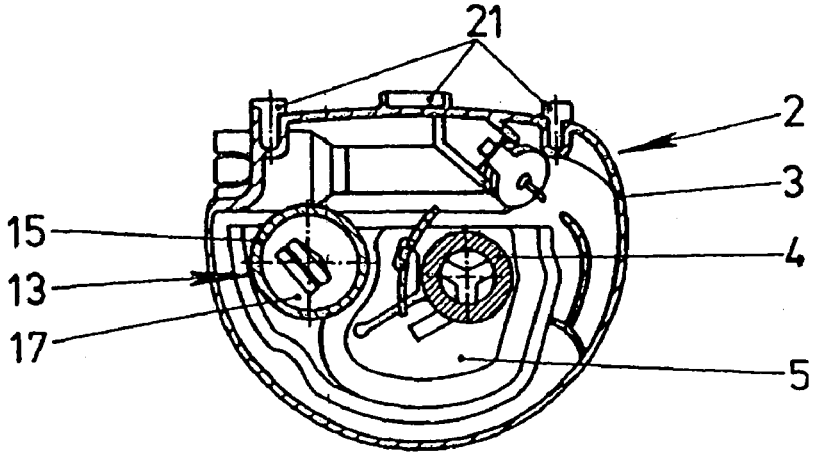
FIG. 2 shows a sectional illustration through the fuel delivery unit according to the invention from FIG. 1 along the line II—II.

FIG. 2 shows, in a sectional illustration through the surge chamber 3 together with the fuel delivery unit 2 from FIG. 1 along the line II—II, that the pipe 15 of the level sensor 13 is positioned at a distance from the delivery pump 4. This prevents the reed switch 16 from being influenced by electromagnetic fields of the electric drive of the delivery pump 4. FIG. 2 furthermore shows that the surge chamber 3 has connecting elements 21 for a holder (not illustrated).

Holders of this type are fastened to the installation cover 6 (illustrated in FIG. 1) and prestress the surge chamber 3 toward the bottom of the fuel tank 1.

The invention claimed is:

1. A fuel delivery unit for use in a fuel tank of a motor vehicle to deliver fuel to an internal combustion engine comprising:

(a) a surge chamber for holding a quantity of fuel separate from the fuel in the fuel tank;

(b) a cover on the surge chamber;

(c) a motor driven fuel delivery pump positioned within the surge chamber and dependent from the surge chamber lid; and (d) a fuel level sensor which includes a pipe depending from the cover of the surge chamber into the surge chamber, the fuel level sensor being positioned within the surge chamber a preselected distance from the delivery pump to detect the level of fuel therein and to supply a fuel level response signal to control operation of the fuel delivery pump motor.

2. The fuel delivery unit as defined in claim 1, wherein the level sensor includes a reed switch.

3. The fuel delivery unit as defined in claim 1, wherein the fuel level sensor comprises a pipe extending over a subregion of the height of the surge chamber.

4. The fuel delivery unit as defined in claim 3, wherein the level sensor comprises a float that is guided by the pipe.

5. The fuel delivery unit as defined in claim 4, wherein a reed switch and the float of the level sensor are positioned in the pipe.

6. The fuel delivery unit as defined in claim 3, wherein the pipe of the level sensor has a constricting opening connecting the interior of the pipe with the fluid in the surge chamber.

7. The fuel delivery unit as defined in claim 2, wherein the level sensor reed switch is connected directly to the delivery pump.

* * * * *